US006231641B1

(12) United States Patent
Utigard et al.

(10) Patent No.: US 6,231,641 B1
(45) Date of Patent: May 15, 2001

(54) ENHANCED PHASE INTERACTION AT THE INTERFACE OF MOLTEN SLAG AND BLISTER COPPER, AND AN APPARATUS FOR PROMOTING SAME

(75) Inventors: Torstein Utigard, Mississauga (CA); John F. Castle; Philip J. Gabb, both of Bristol (GB); David B. George, Salt Lake City, UT (US)

(73) Assignee: Kennecott Utah Copper Corporation, Magna, UT (US)

( * ) Notice: Subject to any disclaimer, the term of this patent is extended or adjusted under 35 U.S.C. 154(b) by 0 days.

(21) Appl. No.: 09/241,141

(22) Filed: Feb. 1, 1999

Related U.S. Application Data

(60) Provisional application No. 60/074,514, filed on Feb. 12, 1998.

(51) Int. Cl.[7] ..... C22B 15/06
(52) U.S. Cl. ..... 75/640; 75/643; 75/644
(58) Field of Search ..... 75/639, 640, 643, 75/644, 645

(56) References Cited

U.S. PATENT DOCUMENTS

| | | | |
|---|---|---|---|
| 4,139,371 | 2/1979 | Makipirtti et al. | 75/73 |
| 4,169,725 | 10/1979 | Makipirtti | 75/74 |
| 4,362,561 | 12/1982 | Weigel et al. | 75/92 |
| 4,394,164 * | 7/1983 | Ma Kinen et al. | 75/645 |
| 4,415,356 | 11/1983 | Victorovich et al. | 75/21 |
| 4,470,845 * | 9/1984 | Yannopoulos et al. | 75/639 |
| 4,940,486 | 7/1990 | Sommerville et al. | 75/10.19 |
| 5,312,525 | 5/1994 | Pal et al. | 204/64 R |
| 5,314,524 | 5/1994 | Pal et al. | 75/10.35 |
| 5,380,353 | 1/1995 | Goto et al. | 75/640 |
| 5,527,374 | 6/1996 | Pal et al. | 75/10.46 |
| 5,700,308 | 12/1997 | Pal et al. | 75/10.1 |
| 5,888,270 | 3/1999 | Edwards et al. | 75/643 |

OTHER PUBLICATIONS

Torres, N., *CIM Bulletin*, vol. 77, No. 871, Nov. 1984, pp. 86–91.

* cited by examiner

*Primary Examiner*—Melvyn Andrews
(74) *Attorney, Agent, or Firm*—Whyte Hirschboeck Dudek SC

(57) ABSTRACT

In a copper converting furnace, the (i) reduction of copper oxide in and the removal of copper metal from the slag, and (ii) conversion of copper sulfide in and the elimination of mineral waste from the blister copper is enhanced by introducing a gas, e.g. nitrogen, into at least one of the blister copper and slag such that the gas increases the turbulence or mixing at the blister copper/slag interface and promotes a lowering of the sulfur dioxide equilibrium pressure within the blister copper and slag phases. In one embodiment, the gas is introduced into both the molten blister copper and slag through a porous-wall injector.

9 Claims, 2 Drawing Sheets

ENHANCED PHASE INTERACTION AT THE INTERFACE OF MOLTEN SLAG AND BLISTER COPPER, AND AN APPARATUS FOR PROMOTING SAME

This application claims the benefit of U.S. Provisional Application No. 60/074,514 filed Feb. 12, 1998.

BACKGROUND OF THE INVENTION

This invention relates to the production of copper. In one aspect, this invention relates to the pyrometallurgical production of copper while in another aspect, this invention relates to the conversion of copper matte to blister copper. In yet another aspect, this invention relates to reducing the sulfur content of blister copper while simultaneously reducing the copper oxide content of molten slag. In still another aspect, this invention relates to an apparatus for enhancing the natural mixing of phases that occurs at the interface of a blister copper layer and a slag layer within a copper converting furnace.

The pyrometallurgical production of copper is a series of multistep concentration, smelting, and refining procedures. Typically starting with an ore comprising one or more of a copper sulfide or copper-iron-sulfide mineral such as chalcocite, chalcopyrite and bornite, the ore is converted to a concentrate containing usually between 25 and 35 weight percent (wt %) copper. The concentrate is then converted with heat and oxygen first to a matte (typically containing between 35 and 75 wt % copper), and then to blister copper (typically containing at least 98 wt % copper). The blister copper is then refined, usually first pyrometallurgically and then electrolytically, to copper containing less than 20 parts per million (ppm) impurities (sulfur plus noncopper metals, but not including oxygen).

The conversion of copper concentrate to blister copper with heat and oxygen is known generally as smelting, and it comprises two basic steps. First, the concentrate is "smelted" to copper matte and second, the matte is converted to blister copper. Typically these steps are performed in separate furnaces, and these furnaces can vary in design. With respect to the first step, i.e. the smelting step, solid copper concentrates are introduced into a smelting furnace of any conventional design, preferably a flash smelting furnace, which is fired by the introduction of fuel and air and/or oxygen through a concentrate burner, and from which slag is tapped periodically and off-gases are routed to waste handling. In a flash smelting furnace, the copper concentrates are blown into the furnace through a burner together with the oxygen-enriched air. The copper concentrates are thus partially oxidized and melted due to the heat generated by the oxidation of the sulfur and iron values in the concentrates so that a liquid or molten bath of matte and slag is formed and collected in the basin (also known as the "settler") of the furnace. The matte contains copper sulfide and iron sulfide as its principal constituents, and it has a high specific gravity relative to the slag. The slag, on the other hand, is composed of gangue mineral, flux, iron oxides and the like, and it has a low specific gravity relative to, and thus floats on top of, the matte.

The molten copper matte and slag are separated in any conventional manner, typically by skimming the molten slag from the matte through tap holes in the furnace walls. The slag tapholes are located at an elevation on the furnace walls that allows slag withdrawal from the furnace without removal of molten matte. Tapholes for the molten matte are located at a lower elevation on the furnace walls that allows the withdrawal of molten matte without the withdrawal of slag. The molten copper matte is then either transferred directly or indirectly (e.g. by way of a holding furnace) to the converting furnace by any conventional means, e.g. launder or ladle, or its converted to solid form, e.g. granulated, for storage and later use as a feed to a converting furnace.

Converting furnaces are basically of two types, flash (also known as suspension) and bath, and the purpose of both furnaces is to oxidize, i.e. convert, the metal sulfides to metal oxides. Representative bath furnaces include those used by Noranda Inc. at its Horne, Canada facility, by Mitsubishi Materials Corporation at its Naoshima, Japan facility, and by Inco Limited at its Sudbury, Canada facility. Representative flash converting furnaces include that used by Kennecott Utah Copper Corporation at its Magna, Utah facility.

Regardless of its design, the converting furnace contains a bath of molten blister copper which was formed by the oxidation of copper matte that was fed earlier by one means or another to the furnace. The bath typically comprises blister copper of about fifty centimeters in depth upon which floats a layer of slag of about 30 centimeters in thickness. If the furnace is a rotary bath-type, then the molten metal and slag, separately of course, are poured from a mouth or spout on an intermittent basis. If the furnace is stationary, then outlets are provided for the removal of both the slag and blister copper. These outlets include tapholes located at varying elevations on one or more of the furnace walls and in a manner similar to that used with the smelting furnace, each is removed from the furnace independent of the other. Other furnace designs use one or more outlets that continuously overflow copper and slag (occasionally using, however, a weir to retain the slag).

The phase separation that occurs between the slag and blister copper is not complete and as such, the slag contains copper (usually in the form of cuprous oxide, i.e. $Cu_2O$, and copper metal, i.e. $Cu^0$) and the blister copper contains various waste and unrecovered mineral values, e.g. sulfur (principally in the form of cuprous sulfide, i.e. $Cu_2S$), ferrosilicates, cuprous oxide, etc. The copper in the slag is lost metal value which is recovered by recycling the slag back to the smelting furnace. The waste and unrecovered mineral values in the blister copper are impurities which are eventually removed either in the anode furnace or through electrorefining.

The oxidation of copper sulfide at the interface of the slag and blister copper phases is known. However, the beneficial effect of this oxidation is minimized, particularly in stationary furnaces, by the relative quiescent state of the interface (because the activities of reacting sulfur and oxygen species must be high enough to produce sulfur dioxide at a pressure greater than that superimposed on the interface by the gas pressure in the furnace (about 1 atmosphere absolute) and the layer of slag above the interface (about 0.1 atmosphere absolute)). The oxidation will also be limited by the time in which the interface exists before the slag and blister copper are separated into different fractions.

SUMMARY OF THE INVENTION

According to this invention, a melt comprising a slag layer floating on top of a blister copper layer, the slag layer containing an oxygen-containing species (e.g. copper oxide) and the blister copper layer containing a sulfur-containing species (e.g. copper sulfide) and a dissolved oxygen-containing species (e.g. dissolved oxygen), is mixed by introducing a gas into at least one of the slag and blister copper layers such that the sulfur-containing species in the blister copper reacts with the oxygen-containing species in the slag or the dissolved oxygen-containing species in the blister copper to form copper metal and sulfur dioxide. The copper metal enters the blister copper layer, and the sulfur dioxide passes through and out of the slag layer. This mixing also promotes the transfer of any copper metal in slag to the blister copper, and the transfer of any mineral waste in the blister copper to the slag. Moreover, this mixing promotes the reduction of the sulfur dioxide partial pressure in the melt which, in turn, promotes the reaction of the sulfur-containing species with the oxygen-containing species, e.g. drives the copper sulfide/copper oxide reaction to the right, i.e. towards the production of the copper metal and sulfur dioxide.

In one embodiment, the gas is introduced into the blister copper by any convenient means, e.g. a porous plug, such that the gas rises to the interface of the molten blister copper and slag so as to increase turbulence or mixing at the interface. In another embodiment, the gas is introduced into the slag by any convenient means, e.g. a lance, such that the gas creates at least a partial turbulent mixing of the slag and blister copper layers. In yet another embodiment, the gas is introduced into both the molten blister copper and slag by any convenient means, e.g. a combination of porous plugs and lances, or porous-wall injectors, etc., so as to increase turbulence or mixing at the interface of the layers or phases. Although the gas is introduced into one or both phases in a manner that expands or blurs the interface between the slag and blister copper layers, it usually is not introduced in a manner that eliminates the slag phase as a separate, discernable phase. In those instances in which such mixing does occur, e.g. in the immediate vicinity in which the gas is injected into the slag from a lance, such time is allowed for the phases to reseparate before one is removed from the other, e.g. by tapping, etc.

In still another embodiment of this invention, the porous-wall injector used to introduce a gas into both the blister copper and slag layers comprises a perforated gas conduit with a first end adapted to receive gas from a gas source and a second end adapted for discharge of the gas, the conduit encased in a porous sheath, the sheath spaced apart from the conduit by at least one spacing means to form a first gas diffusion region. Optionally and preferably, the porous-wall injector further comprises a perforated support plate attached to the second end of the conduit, the support plate encased in a support block fitted with a porous plug located beneath and spaced apart from the support plate to form a second gas diffusion region. a gas conduit with gas pores encased in a refractory sheath. The gas is discharged into the surrounding metallurgical melt (both the blister copper and slag layers) through the perforations or gas pores of the conduit into and through the gas diffusion space and into and through the encasing porous sheath. The gas leaves the injector as a plume of bubbles that stirs or agitates the blister copper/slag interface.

DESCRIPTION OF THE PREFERRED EMBODIMENT

As here used, "metallurgical melt" or simply "melt" means the molten contents of a metallurgical vessel, e.g. a furnace, forebay, etc. The melt in the settler of a copper converting furnace typically comprises a slag phase floating on top of a blister copper phase. If a forebay is attached to and in open communication with the settler of the converting furnace, then the melt of the forebay is the same as the melt of the furnace (at least the same as that part of the melt in the settler near the entrance to the forebay).

Although the following description of the invention is in the context of a continuous flash converting furnace, this is but one embodiment of the invention. This invention is applicable in other embodiments, e.g. continuous bath converters, particularly quiescent bath converters, as well.

Various aspects of the invention are described by reference to the drawings in which like numerals are employed to designate like parts and features. Although various items of equipment, such as fittings, mountings, pipes, and the like, have been omitted so as to simplify the description, such conventional equipment can be employed as desired.

Figure 1:
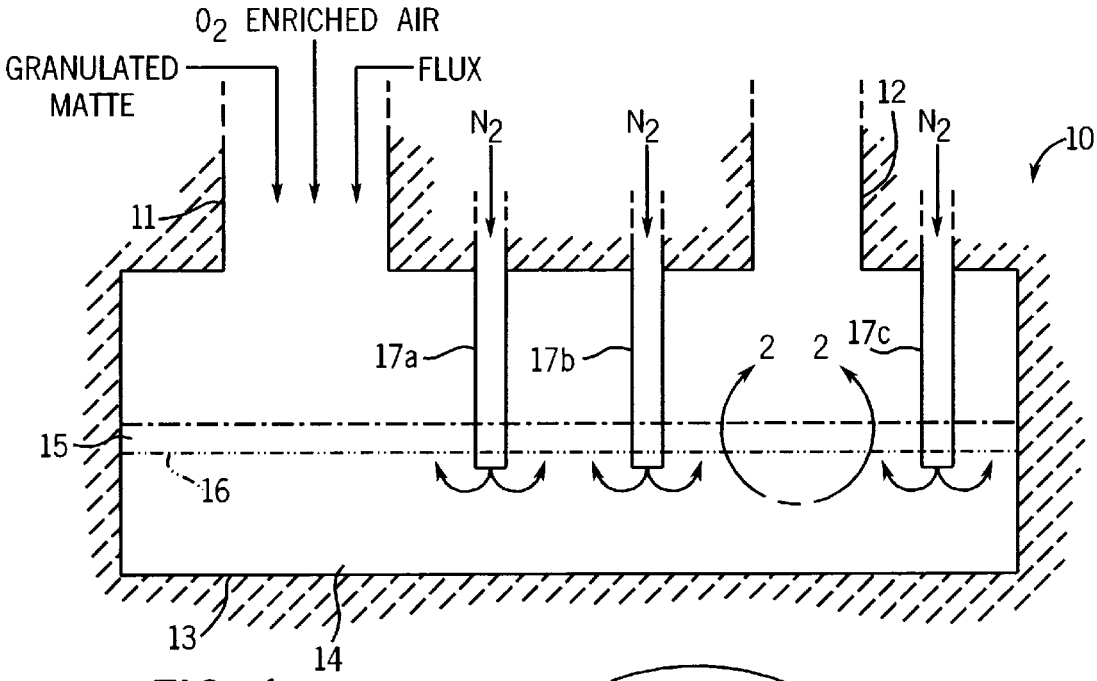
FIG. 1 is a side, cut-away view of a continuous flash converting furnace depicting molten slag floating upon molten blister copper.

In FIG. 1, continuous flash converting furnace 10 is equipped with a reaction shaft 11 and a riser or uptake shaft 12. Granulated matte, oxygen-enriched air and flux are mixed, melted and combusted within reaction shaft 11 to form blister copper and slag which drop into settler zone 13 of the furnace. Blister copper 14 pools within settler zone 13, and slag 15 floats on top of the blister copper (due to the fact that the slag has a lower specific gravity than does the blister copper) forming interface 16. Exhaust gases, which include sulfur dioxide, are vented from the furnace through riser 12.

In the operation of a conventional continuous flash converting furnace, the slag and blister copper form a quiescent, two-phase pool within the settler region of the furnace. The slag will contain, among other things, gangue mineral, flux, iron oxides, copper oxides (principally in the form of $Cu_2O$) and copper metal, while the blister copper will contain, among other things, copper metal ($Cu^0$), copper oxides (also principally in the form of $Cu_2O$), copper sulfides (principally in the form of $Cu_2S$) and gangue mineral. The principal source of lost copper values during the converting process is $Cu^0$ and $Cu_2O$ dissolved in the slag. Typically these copper values are recovered by recycling the slag to the smelting furnace.

Figure 2:
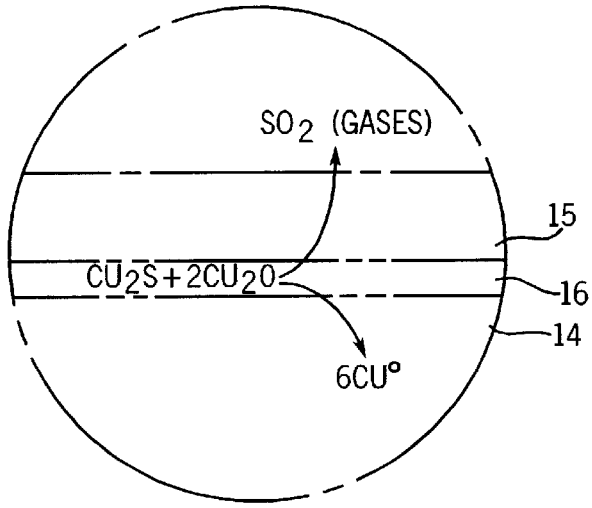
FIG. 2 is a magnified view of FIG. 1.

As shown in FIG. 2, cuprous sulfide and cuprous oxide react with one another at interface 16 of the slag and blister copper under normal operating furnace conditions (e.g. at a temperature between about 1100 C and about 1500 C, preferably between about 1125 and about 1400 C and more preferably between about 1150 and about 1350 C) to form copper metal and sulfur dioxide ($SO_2$). The molten copper metal settles into the blister copper pool, and the sulfur dioxide passes through the slag layer into the freeboard above the layer for ultimate removal from the furnace through riser 12.

The efficiency of this reaction depends, in large part, upon the ability of sulfur-containing and oxygen-containing species (e.g. cuprous sulfide and cuprous oxide) to react with one another. While the path for this reaction is uncertain at the moment, one possible path is for the sulfur-containing species in the blister copper to contact the oxygen-containing species in the slag. Another possible path is for the sulfur-containing species in the blister to react with the oxygen-containing species in the blister upon gas injection which allows for sulfur dioxide formation at low partial pressures, e.g. less than one atmosphere. As the oxygen-containing species in the blister copper is depleted, oxygen-containing species in the slag will begin to diffuse into the blister copper effectively reducing the oxygen content of the slag. In this instance, the copper sulfide in the blister does not need to be in contact with the slag for the reaction to progress.

In the normal operation of a continuous flash converting furnace, the efficiency of the copper sulfide/copper oxide reaction is dependent upon, among other things, the amount of time the slag and blister copper phases are in contact with one another within the furnace, the amount of cuprous sulfide in the blister copper, the amount of cuprous oxide in the slag, the depth of the interface of the slag and blister copper layers, and the like. In the conventional operation of a continuous flash converting furnace, the amount of copper lost with the removal of the slag is typically between about 1 and about 5 weight percent (based on the weight of the copper in the matte (and any other source of copper fed to the furnace)), and the amount of cuprous sulfide in the blister copper is typically between about 5000 and about 20000 ppm (1000 to 4000 ppm sulfur equates to about 5000 to about 20000 ppm $Cu_2S$).

In one embodiment of this invention, cuprous oxide in any form (preferably in finely divided form) is added to the melt in any suitable manner (e.g. through a lance) if the amount of cuprous sulfide in the blister copper exceeds the amount of cuprous oxide in the slag necessary for complete reaction of all the available cuprous sulfide to copper metal. Likewise, cuprous sulfide in any form (preferably in finely divided form) is added to the melt in any suitable manner (e.g. through a lance) if the amount of cuprous oxide in the slag exceeds the amount of cuprous sulfide in the blister copper necessary for complete reaction of all the available cuprous oxide to copper metal. The relative amounts of copper sulfide and copper oxide in the melt are monitored by any convenient means to maximize the removal of oxygen and sulfur from the melt.

In one embodiment of this invention, the efficiency of the reaction described in FIG. 2 is enhanced by sparging at a point or points in the blister copper and near the interface a gas, preferably an inert gas such as nitrogen, argon, etc., although reactive gases such as oxygen, carbon monoxide, methane, etc., can also be used for the additional purpose of controlling or influencing the oxidation and/or reduction reactions occurring in the melt. If a reactive gas is used, preferably it is used in combination with an inert gas, particularly in a combination in which the inert gas comprises a majority of the gas introduced to effect mixing and the reduction of the partial pressure of sulfur dioxide.

The gas is injected into the melt through one or more roof or sidewall mounted lances such that the gas agitates and deepens the interface to form a two phase layer or emulsion without destroying either the slag or blister copper layer. As shown in FIG. 1, gas lances 17*a–c* pierce slag layer 15 and discharge nitrogen at points below interface (also known as an emulsion) 16. The nitrogen bubbles to and through interface 16 and in the process of this bubbling, it promotes or induces mixing of the blister copper and slag. This mixing, in turn, promotes reaction of the excess sulfur in the blister copper with the excess cuprous oxide in the slag, which in turn simultaneously reduces the amount of cuprous oxide in the slag and the amount of cuprous sulfide in the blister copper.

The number, placement and design of the lances (one important feature of which is the size and shape of the nitrogen plume that each creates) can and will vary with the design of the furnace, the amounts of cuprous oxide in the slag and cuprous sulfide in the blister copper, and the amount of time after sparging required for the emulsion to reseparate to an extent that will allow for an efficient removal of one layer from the other without entrained material from the other layer. Typically, the lances will be placed in a pattern about the furnace that will ensure optimum enhancement of the interface mixing of the layers (i.e. will minimize the number and size of stagnant areas) across the total area of the interface. One such pattern is arraying the lances across the width of the settler between the reaction shaft and the uptake shaft (in the form of a "curtain").

Variables such as bubble size, rate of gas injection, depth of gas injection relative to the interface, and the like can vary to convenience with the proviso that the integrity of the individuals layers are not comprised to an extent that an efficient separation of the phases is significantly impeded. This sparging also enhances the settling of copper metal from the slag into the blister copper, especially in those situations in which larger droplets contact with one another and form even larger particles (i.e. the particles coalesce) which are more easily separated from the slag than any of the droplets individually.

In another embodiment (not shown), the lances are not in contact with either the blister copper or slag layer. In this embodiment, the end of the lance from which the gas is discharged remains above the top surface of the slag layer. The discharged gas impacts the slag layer with a force at least sufficient to cause the interface between the slag and blister copper layers to enlarge (deepen) and in certain embodiments, with sufficient force to virtually drive the slag layer beneath the lance into the blister copper layer so as to render indiscernible two separate phases, i.e. a slag phase floating on top of a blister copper phase.

In addition to the enhanced mixing of the two layers, the injection of the gas into the furnace (regardless of the location relative to the phases, i.e. regardless of whether the gas is injected into one or both phases and regardless of whether the gas is injected directly into a phase or above the slag phase) reduces the partial pressure of the sulfur dioxide in the gas bubbles contained within the mixed phases and this, in turn, shifts the equilibrium of the reaction described in FIG. 2 to the right, i.e. it favors the production of copper metal and sulfur dioxide. Moreover, the better the contact by mixing with the gas, the better the sweeping action of the gas in improving the kinetics of sulfur dioxide evolution.

In another embodiment of this invention (which is not shown in the Figures), the gas is sparged into the blister copper from porous plugs located in the side walls and/or floor of the settler. While effective to the extent that the gas discharged from these plugs gently agitates the interface, this method of sparging is less favored (relative to sparging through top or sidewall mounted lances) for several reasons. First, plugs on the settler floor are more difficult to position relative to the interface (porous plugs are typically nonadjustable once installed whereas lances can be extended into or withdrawn from the metallurgical melt over a rather wide range. Second, since porous plugs are completely submerged within the blister copper, they are more susceptible to blockage than a lance. Third, any devices installed on the floor or sidewalls of the settler are more difficult to maintain simply from the logistics of access to the part. Access for maintenance and repair of roof and sidewall mounted lances, on the other hand, is much more readily available.

Figure 3:
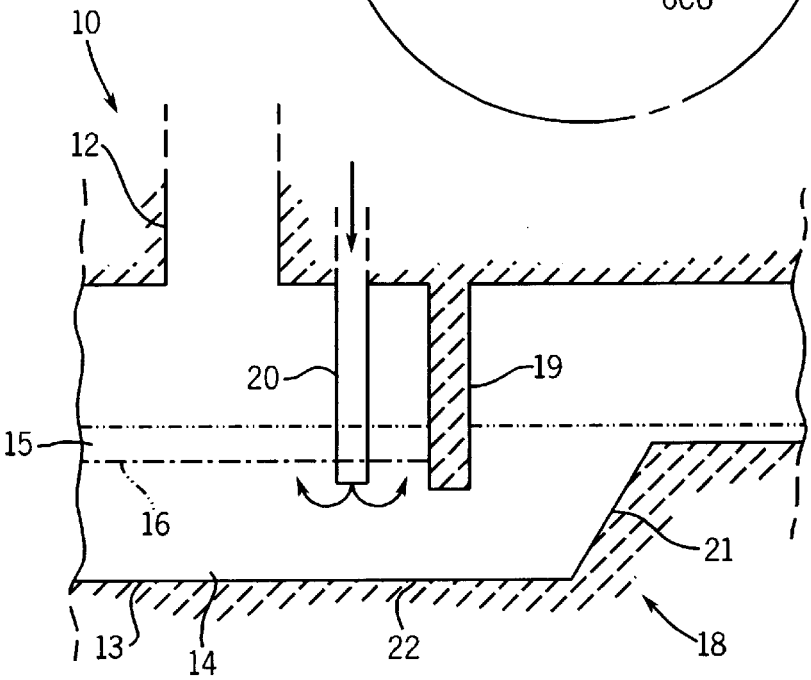
FIG. 3 is a side, cut-away view of the furnace of FIG. 1 to which is attached a forebay also shown in a side, cut-away perspective.
Figure 4:
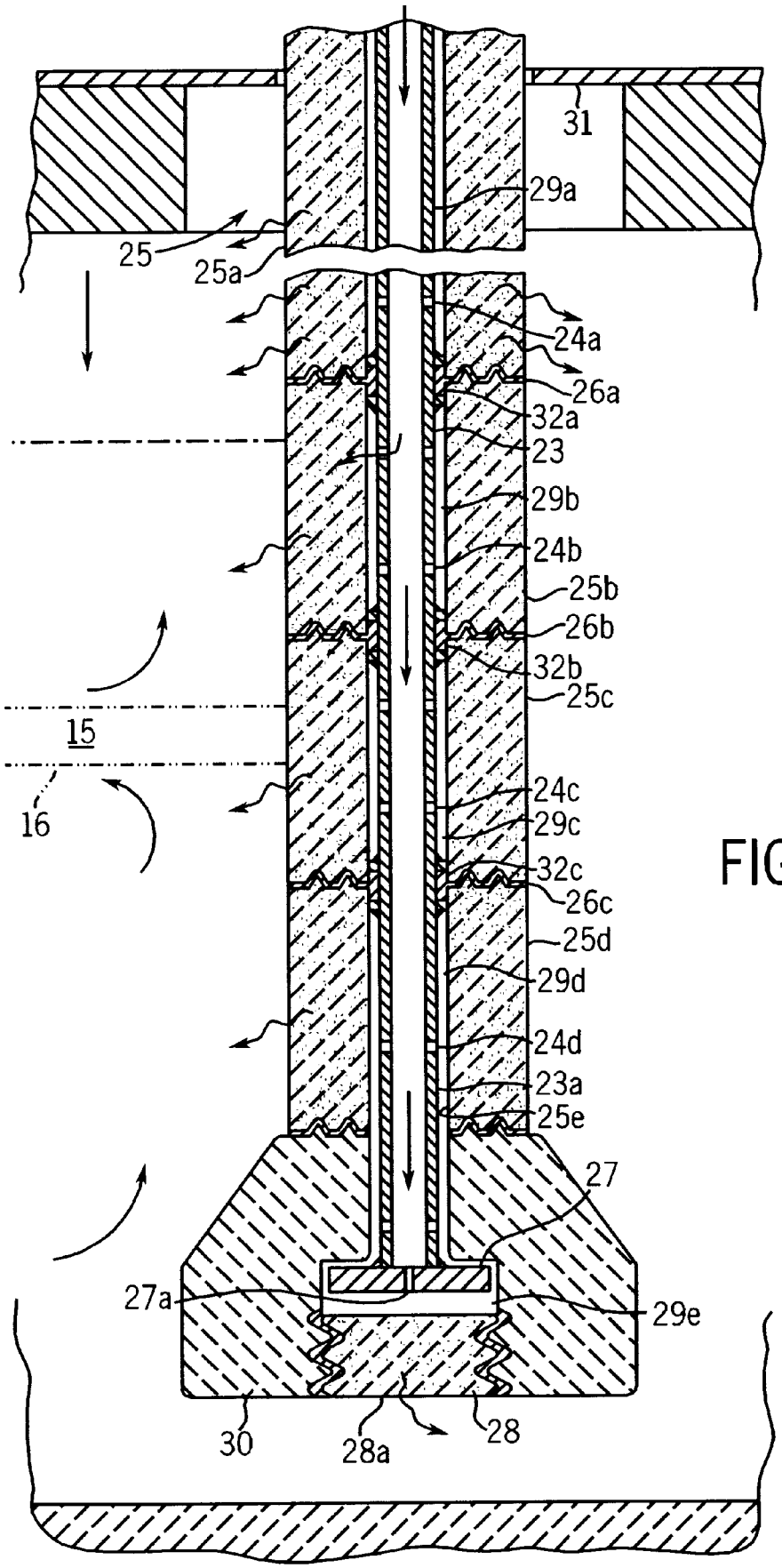
FIG. 4 is a side perspective of the porous-wall injector depicted in FIG. 3.

FIGS. 3 and 4 describe yet another embodiment of this invention. FIG. 3 shows furnace 10 in combination with forebay 18 which is in open communication with settler 13 such that both layers of the melt enter the forebay in substantially the same arrangement in which they exist in the settler, i.e. a two-phase melt in which slag layer 15 floats upon blister copper layer 14. Forebay 18 can be of any design, e.g. full depth, stepped, etc., and it is equipped with both weir 19 and porous-wall injector 20. Although not shown, forebay 18 can also be equipped with one or more porous plugs. Weir 19 is positioned within forebay 18 such that it acts as a dam to slag layer 15, but blister copper layer 14 can pass beneath it for ultimate removal by way of forebay riser 21. By means not shown, slag is separated from the blister copper in slag skimming area 22 of the forebay (i.e. that part of the forebay between the furnace and the weir). The forebay is more fully described in copending application U.S. Ser. No. 60/074,516 filed Feb. 12, 1998 which is incorporated herein by reference.

In this embodiment of the invention, one or more porous-wall injectors are mounted to the roof or lid of the forebay and when the lid is in a closed position, the porous-wall injector(s) extends through the slag layer into the blister copper layer. One or more gases, e.g. nitrogen or nitrogen in combination with an oxygen-containing gas, is discharged from the injector in a manner that interface 16 is gently agitated or stirred.

The injector itself is shown in greater detail in FIG. 4, and it comprises pipe or other gas conduit 23 of any cross-sectional geometry containing gas holes or pores 24*a–d*. Pipe 23 is encased in but spaced from porous refractory shroud 25 which comprises porous refractory segments 25*a–d* which are joined to one another by grouted labyrinth joints 26*a–c*. Inner surface 25*e* of porous refractory shroud 25 is spaced from outer surface 23*a* of pipe 23 by spacers 32*a–c* to form gas diffusions spaces 29*a–d*. Pipe 23 extends from a gas source (not shown) located external to the forebay to support plate 27 itself containing at least one gas pore 27*a*. Beneath support plate 27 is bottom porous plug 28, and the end of pipe 23, support plate 27 and bottom porous plug 28 are encased in injector support block 30. Support plate 27 and bottom porous plug 28 are position one from the other within injector support block 30 such as to create gas diffusion space 29*e*. To ensure a gas tight seal, injector 20 passes through sealing plate 31 which is attached by any suitable means (e.g. welding, mechanical fasteners, etc.) to the forebay roof or lid. Sealing plate 31 is protected from the heat and corrosion of the metallurgical melt, of course, by a suitable refractory shield.

In another embodiment not shown, the injector further comprises a means for injecting a finely divided solid into the melt. Representative of this embodiment is an injector which comprises two concentric conduits, e.g. tubes or pipes. The finely divided solid is injected into the melt through the inner conduit, and the gas is injected into the melt through the annulus defined by the outer surface of the inner conduit and the inner surface of the outer conduit. In this regard, the porous-wall injector can be used as a means for adding, for example, copper oxide to the melt in those situations hi in which the melt contains an insufficient amount of copper oxide to react with the amount of copper sulfide in the melt. As another example, the porous-wall injector can be used as a means for adding copper sulfide to the melt in those situations in which the melt contains an insufficient amount of copper sulfide to react with the amount of copper oxide in the melt.

In practice, porous-wall injector 20 extends from the roof or ceiling of forebay 18 (and in other embodiments of this invention, and/or from the ceiling or side of furnace 10) into and through slag layer 15 and interface 16, and into blister copper layer 14 such that bottom surface 28*a* of bottom porous plug 28 is positioned near (e.g. within 15 cm) the floor of the slag skimming chamber. Gas is fed through pipe 23 under sufficient pressure (e.g. between about 10 and about 100 psig) such that not only does it discharged through all of the gas pores along the length of pipe 23 (and thus into gas diffusion spaces 29*a–e*), but it also discharges through all of the porous refractory adjacent gas diffusion spaces 29*a–e* to create a desired plume about the exterior of the injector.

The design of the porous-wall injector provides a number of benefits with respect to stirring gently the interface that are not available from standard lances or porous plugs. First and foremost, because the porous-wall injector discharges gas from near its entire length and not just from its bottom plug (as would a lance), the gases stir all of the material about the injector. Thus not only is the interface stirred from the blister copper layer, but it is also stirred from the slag layer (as opposed to either a lance or a porous plug which will stir only the layer in which its discharge opening is located (typically the blister copper layer)). Moreover, by stirring both layers over their entire depths, the gases create currents within each layer that result in more volume from each layer coming into contact with more volume of the other layer (and thus more opportunity for the cuprous sulfide and cuprous oxide to react with one another, and more opportunity for copper metal to settle into the blister copper layer and more opportunity for slag mineral values to rise into the slag layer).

Second, since the porous-wall injector is engulfed in its own gas plume, it suffers less corrosive wear than a porous plug or lance because the gas plume not only stirs the material surrounding the injector, but it also keeps it spaced from the surface of the injector. In other words, the discharged gas acts also a protective envelope about the injector, thus extending its useful life. Moreover, this is true, i.e. the forming of a protective and cooling envelope, in the freeboard space above the metallurgical melt in which the injector is otherwise in contact with the corrosive gases (e.g. $SO_2$) and entrained molten solid particles of slag and semis-melted concentrate generated by the pyrometallurgical process prior to their removal from the furnace.

Third, by discharging the gases over near the entire length of the injector, more volume of gas can be injected into the melt in a more gentle manner than could a similar volume of gas through a smaller discharge port (such as those of a lance or porous plug). Thus more stirring is achieved with less likelihood of destruction of the individual phases.

Other benefits of this invention include the reduction in the partial pressure of sulfur dioxide (which in turn drives the chemistry of the reaction of cuprous sulfide and cuprous oxide to produce copper metal and sulfur dioxide), increased heat transfer from gases above the bath through the slag layer into the blister copper layer, lower corrosivity of the slag due to a reduced copper oxide content, improved fire refining due to a lower sulfur content in the blister copper, improved sulfur capture in the converting furnace (which in turn means less scrubbing of subsequent fire refining off gases is required), and a slag phase with a lower copper content due to the improved droplet coalescence.

The porous-wall injectors of this invention can be used alone or in combination with one or more lances and/or one or more porous plugs. Preferably the porous-wall injectors are used alone, at least with respect to stirring the blister copper/slag interface (as opposed to using the lances and/or plugs for another purpose, e.g. introducing an oxidant into the blister copper or a reductant into the slag).

Although the invention has been described in considerable detail through the preceding embodiments, this detail is for the purpose of illustration. Many variations and modifications can be made without departing from the spirit and scope of the invention as described in the appended claims.

What is claimed is:

1. A method of mixing a melt comprising a slag layer floating on top of a blister copper layer, the slag layer containing an oxygen-containing species and the blister copper layer containing a sulfur-containing species and a dissolved oxygen-containing species, the melt held within a settler zone of a bath copper converting furnace equipped to receive molten copper matte at a first location within the settler zone of the furnace, the method comprising the step of introducing a gas into at least one of the slag and blister copper layers at a second location within the settler zone of the furnace such that the sulfur-containing species in the blister copper reacts with the oxygen-containing species in the slag or the dissolved oxygen-containing species in the blister copper to form copper metal and sulfur dioxide.

2. The method of claim 1 in which the gas is introduced into the slag layer.

3. The method of claim 1 in which the gas is introduced into the blister copper layer.

4. The method of claim 1 in which the gas is introduced into both the slag and blister copper layers.

5. The method of claim 1 in which the copper converting furnace is a flash copper converting furnace equipped with a reaction shaft for receiving and converting solid copper matte to molten blister copper the latter of which is collected in a location of the settler beneath the reaction shaft, and the gas is introduced into at least one of the slag and blister copper layers at a location within the settler apart from the region beneath the reaction shaft.

6. The method of claim 5 in which metallic copper is added to the slag phase in combination with the gas.

7. The method of claim 6 in which the mixing is conducted at a temperature between about 1100 and about 1500 C.

8. The method of claim 7 in which the gas is nitrogen.

9. The method of claim 1 in which at least one of cuprous sulfide and cuprous oxide is added to the melt in combination with the gas.

* * * * *